United States Patent [19]

Hummer et al.

[11] 4,354,869

[45] Oct. 19, 1982

[54] PROCESS FOR PURGING ALUMINUM AND ALUMINUM ALLOY MELTS OF SMALL QUANTITIES OF ALKALI AND ALKALINE EARTH METALS

[75] Inventors: Roland Hummer; Joseph Reinisch; Wolfgang A. Thury, all of Leoben, Austria

[73] Assignee: Metals & Alloys Company Limited, Canada

[21] Appl. No.: 265,172

[22] Filed: May 19, 1981

[30] Foreign Application Priority Data

May 27, 1980 [AT] Austria ..... 2793/80

[51] Int. Cl.[3] ..... C22B 21/06

[52] U.S. Cl. ..... 75/63; 75/68 R; 75/93 AC

[58] Field of Search ..... 75/68 R, 93 R, 93 AC, 75/63

[56] References Cited

U.S. PATENT DOCUMENTS 1,092,936 4/1914 Mellen ..... 75/68 R 4,052,198 10/1977 Yarwood et al. ..... 75/93 R

FOREIGN PATENT DOCUMENTS 354114 12/1979 Austria .

744121 1/1944 Fed. Rep. of Germany ..... 75/68 R 2001901 7/1971 Fed. Rep. of Germany ..... 75/68 R 1147970 4/1969 United Kingdom ..... 75/68 R 718491 5/1978 U.S.S.R. ..... 75/68 R

OTHER PUBLICATIONS

Whiting et al., "Removal of Magnesium from Aluminum by Fumeless Chlorine Treating", AFS-Transactions 82 (1974) pp. 189-192.

*Primary Examiner*—M. J. Andrews

*Attorney, Agent, or Firm*—Bacon & Thomas

[57] ABSTRACT

Small quantities of alkali metal and alkaline earth metal impurities are removed from an aluminum melt by introducing a source of sulfur such as elemental sulfur, which combines with the impurity to form an impurity-containing slag, purging the melt with gas to remove excess sulfur, and separating the purified melt from the slag.

11 Claims, No Drawings

PROCESS FOR PURGING ALUMINUM AND ALUMINUM ALLOY MELTS OF SMALL QUANTITIES OF ALKALI AND ALKALINE EARTH METALS

The presence of some alkali and alkaline earth metals in aluminum or aluminum alloy-melts can be detrimental. It is therefore desirable to reduce the contents of these elements to very low levels. According to the present state of engineering this is achieved by purging the melt with chlorine gas (with or without an addition of inert gases), with gaseous chlorine compounds (also frequently mixed with inert gases), or through a treatment with solid substances, e.g. halogenous salts. These processes have the disadvantage that not only those elements which are to be removed, but also aluminum reacts to form aluminum chloride, which initially escapes as gas but forms smoke later on. This smoke is harmful to the environment and therefore the waste gases have to be cleaned. The loss of aluminum is also a waste of energy, since aluminum can only be produced with considerable amounts of energy. Besides this chlorine treatment lasts a very long time. Holding a melt for a long time consumes large amounts of energy and also requires furnace capacity.

Primary aluminum sometimes contains small amounts of lithium. Lithium is occasionally added on purpose to aluminum during the extraction process in order to save energy during electrolysis. Moreover, sodium may be formed unintentionally from cryolite during electrolysis. Sometimes small amounts of sodium get into secondary aluminum out of the scrap. Traces of sodium as well as of lithium have, in particular in aluminum wrought alloys, the disadvantage that they may cause defects such as cracks formed during rolling.

Other alkali metals, although usually not present in technically pure aluminum, would undoubtedly cause similar disadvantages.

Recycling of aluminum scrap is of great importance, since—as already mentioned—aluminum has a very high "energy content". Scrap metal is usually in the form of wrought material, which often contains 1 to 2 weight % of magnesium. Scrap material is converted to casting alloys mainly by remelting. These mostly contain 5 to 9% silicon, 4 to 1% copper and some zinc (all percentages meaning weight %). The magnesium content of these casting alloys should normally not exceed 0.3%, more preferably not even 0.15% for special grades, otherwise these alloys become too brittle. For example, the following alloys are listed in the standard DIN 1725:

G-AlSi8Cu3: 0.3% Mg max.

G-AlSi6Cu4: 0.1 to 0.3% Mg

In remelting plants melts must be purged with chlorine gas for a long period of time, in order to reduce magnesium contents to the above mentioned levels. This causes high aluminum losses and contaminates the environment, unless costly waste gas cleaning equipment is installed. According to the stoichiometric ratio, 3 kg of chlorine gas are needed for the removal of 1 kg magnesium. L. V. Whiting and J. O. Edwards, AFS-Transactions 82 (1974) pages 189 to 192 report that a 30 t melt, containing 0.5% Mg must be purged for two to four hours at a rate of 150 kg chlorine gas per hour in order to reduce the magnesium content to 0.1%.

In some aluminum alloys contamination with small quantities of calcium is highly detrimental. Calcium can for example occur in aluminum-silicon alloys, if cheap raw silicon is used for alloying. This usually contains considerable amounts of calcium, occasionally 2–4%. It is therefore imperative to use pure silicon for alloying. This is very expensive, since it is very difficult to completely eliminate small quantities of calcium. Traces of calcium cause porosity of a more or less extent in aluminum-silicon alloys.

More recently strontium, instead of sodium, has been used for modifying aluminum-silicon alloys. Strontium remains in the metal, even when this is re-melted. However, remaining traces of strontium can be of disadvantage in casting alloys, if these are introduced through a re-melting of scrap metals. The presence of small quantities of barium would probably also be a disadvantage in aluminum alloys, but this contamination rarely occurs at present.

All these alkali and alkaline earth metals can be removed from aluminum melts by chlorine gas treatment, but with all disadvantages already mentioned. The present inventors have disclosed in Austrian Pat. No. 354,114 a process for treating aluminum melts with sulfurhexafluoride gas in order to remove lithium from the melt. This process could be carried out for all other alkali and alkaline earth metals too, but it has the disadvantage that sulfur-hexafluoride is far too expensive.

The present invention provides a process for the removal of small quantities of an impurity selected from the group consisting of alkali metals, alkaline earth metals, and mixtures thereof, from an aluminum or aluminum alloy melt, comprising introducing a source of sulfur other than sulfurhexafluoride into the melt, permitting the sulfur to react with said small quantities of impurity to form an impurity-containing slag, purging the melt with a gas in quantities sufficient to remove residual sulfur remaining in the melt, and separating the purified melt from the impurity-containing slag.

Preferably the source of sulfur is introduced by plunging it into the melt. The source of sulfur may comprise elemental sulfur, or sulfur compounds which release sulfur. This process is cheap because the reaction time is short. In small units, the sulfur may be wrapped in aluminum foil and then plunged into the melt. In large units, cylindrical plungers or bells for 1 or 2 kg compacted sulfur rods are efficient. It is, however, also possible to introduce sulfur in powdered form with the aid of a carrier gas. The latter may be inert with respect to aluminum or may be mixed with a small quantity of a reactive gas, for example a halogenous gas. Naturally it is highly advisable to perform the addition in such a way that the reaction take place as completely as possible, thus minimizing the formation of sulfur dioxide. Particularly for large treatment units it will however be necessary to carry out waste gas cleaning if emissions of undesirable waste gases prove to be a problem.

Sulfur evaporates at the temperature of the melt and permeates the melt in the same way as it is the case with gas-purging, but without needing special equipment. Plunging bells are available in every foundry or melting plant. The lower the content of the element to be removed in the aluminum melt, the higher the excess of sulfur needed over and above the stoichiometric ratio.

Not all reaction products go after the sulfur treatment into slag. Residual sulfides could influence the quality of metal disadvantageously. Therefore after the sulfur treatment purging by gas is necessary. The most efficient purging is a chlorine gas purging of 2 to 5 minutes, but also inert gases like nitrogen or argon may be sufficient. Purging with a mixture of nitrogen and chlorine or with hexachloroethane is also highly effective. The purging gas may be introduced simultaneously with or subsequently to the introduction of the source of sulfur.

Some examples of the process will now be described.

EXAMPLES

EXAMPLE 1

A 10 kg-melt of the aluminum-silicon alloy G-AlSi12 with 12 to 13% Si was held at 700° C. in a graphite crucible in an induction furnace. Additions of lithium, sodium, calcium and magnesium were intentionally made to the melt. 7 g of sulfur were plunged down to the bottom of the crucible in intervals of 5 minutes by adding flowers of sulfur with a plunging bell. Samples were taken after each stage of treatment. The following results were obtained:

| | % Li | % Na | % Ca | % Mg |
|---|---|---|---|---|
| Before treatment | 0.0119 | 0.0043 | 0.0020 | 0.068 |
| 1st stage | 0.0053 | 0.0021 | 0.0017 | 0.055 |
| 2nd stage | 0.0029 | 0.0015 | 0.0015 | 0.050 |
| 3rd stage | 0.0016 | 0.0014 | <0.0005 | 0.044 |

These experiments show that the effect of the treatment is satisfactory with regard to lithium and calcium, but that the results obtained in the case of sodium and magnesium were not so positive, although nevertheless noticable removals were achieved.

It was further observed that the melt still contained some sulfur at the end of the experiment. It is therefore necessary, to purge the melt with gas after the treatment. In small units it will probably be beneficial to plunge the sulfur together with a halogenous compound, possibly hexachloroethane ($C_2Cl_6$), which is commonly used in foundries.

EXAMPLE 2

An addition of magnesium was added to a 9.5 kg melt of G-AlSi12, which was held at temperature in the same manner as described for the previous example. An addition of 14 g sulfur, which was wrapped in aluminum foil, was plunged at a temperature of 700° C. The following chemical analyses resulted:

Before treatment: 0.243% Mg

After tretment: 0.178% Mg

This result is satisfactory. This treatment illustrates very well how a short and simple treatment can improve the properties of an alloy and particularly its ductility. The treatment would probably have had better success, had it been carried out in a number of stages with smaller amounts of sulfur.

According to this example, a balance for a 100 kg melt would result in a consumption of 147.4 g sulfur for the removal of 65 g of magnesium, which corresponds to a yield of approximately 58%.

EXAMPLE 3

In a 10 t-melt of the alloy G-AlSi7Cu3 (aluminum alloy with 7% Si and 3% Cu) cylindrical bells with compacted sulfur rod were plunged. Each bell contained 1 or 2 kg sulfur. The treating time for each bell was 1.5 to 2.5 minutes and it was possible to plunge two or three bells together. After the treatment the melt was refined by chlorine-nitrogen gas mixture (50:50) for 4 minutes. Afterwards the melt was free of sulfur.

For diminishing the magnesium content from 0.25% to 0.15% 33 kg of sulfur were necessary. The yield was 40%, which appears to be very good at such low magnesium content. Furthermore, the treatment time was noticeably short.

We claim:

1. Process for the removal of small quantities of an impurity selected from the group consisting of alkali metals, alkaline earth metals, and mixtures thereof, from an aluminum or aluminum alloy melt, comprising introducing into the melt at a temperature not substantially in excess of about 700° C. a source of sulfur other than sulfurhexafluoride substantially free from any content of metal ion, permitting the sulfur to react with said small quantities of impurity to form an impurity-containing slag, purging the melt with a gas in quantities sufficient to remove residual sulfur remaining in the melt, and separating the purified melt from the impurity-containing slag.

2. Process according to claim 1 in which said gas is introduced simultaneously with said source of sulfur.

3. Process according to claim 1 in which said gas is introduced subsequently to the introduction of said source of sulfur.

4. Process according to claim 1 in which said source of sulfur is a sulfur-releasing compound.

5. Process according to claim 1 in which said source of sulfur is elemental sulfur.

6. Process according to claim 5, comprising the step of plunging said elemental sulfur into the melt.

7. Process according to claim 5, wherein said elemental sulfur is in finely divided form and is injected into the melt in suspension in a carrier gas.

8. Process according to claim 7 wherein the carrier gas is inert with respect to aluminum.

9. Process according to claim 8 wherein the carrier gas comprises a mixture of said inert gas and a minor quantity of a halogenous gas.

10. Process according to claim 1, wherein said purging gas is selected from the group consisting of argon, nitrogen, chlorine, and mixtures thereof.

11. Process according to claim 1 wherein said purging gas is hexachloroethane.

* * * * *